United States Patent [19]

Whitaker, Jr.

[11] Patent Number: 4,848,426

[45] Date of Patent: Jul. 18, 1989

[54] ADZER CRIBBER

[75] Inventor: John B. Whitaker, Jr., Wetumpka, Ala.

[73] Assignee: Kershaw Manufacturing Co., Inc., Montgomery, Ala.

[21] Appl. No.: 299,621

[22] Filed: Jan. 23, 1989

[51] Int. Cl.[4] ..... B27C 5/00

[52] U.S. Cl. ..... 144/133 B; 144/3 R; 144/367; 144/252 R

[58] Field of Search ..... 144/1 R, 3 R, 133 R, 144/133 B, 252 R, 367

[56] References Cited

U.S. PATENT DOCUMENTS 2,336,652 12/1943 Talboys ..... 144/133 B 2,527,668 10/1950 Woolery ..... 144/133 B

*Primary Examiner*—W. Donald Bray

*Attorney, Agent, or Firm*—Jennings, Carter, Thompson & Veal

[57] ABSTRACT

Track maintenance apparatus for use in railroad track maintenance utilizes a forward cribber unit to remove ballast from between the crossties and a rear adzer unit to smoothen any irregularities in the crosstie surface during a track re-laying operation. A single worker can perform both the cribbing and adzing tasks without dismounting from the apparatus.

9 Claims, 2 Drawing Sheets

FIG. 1
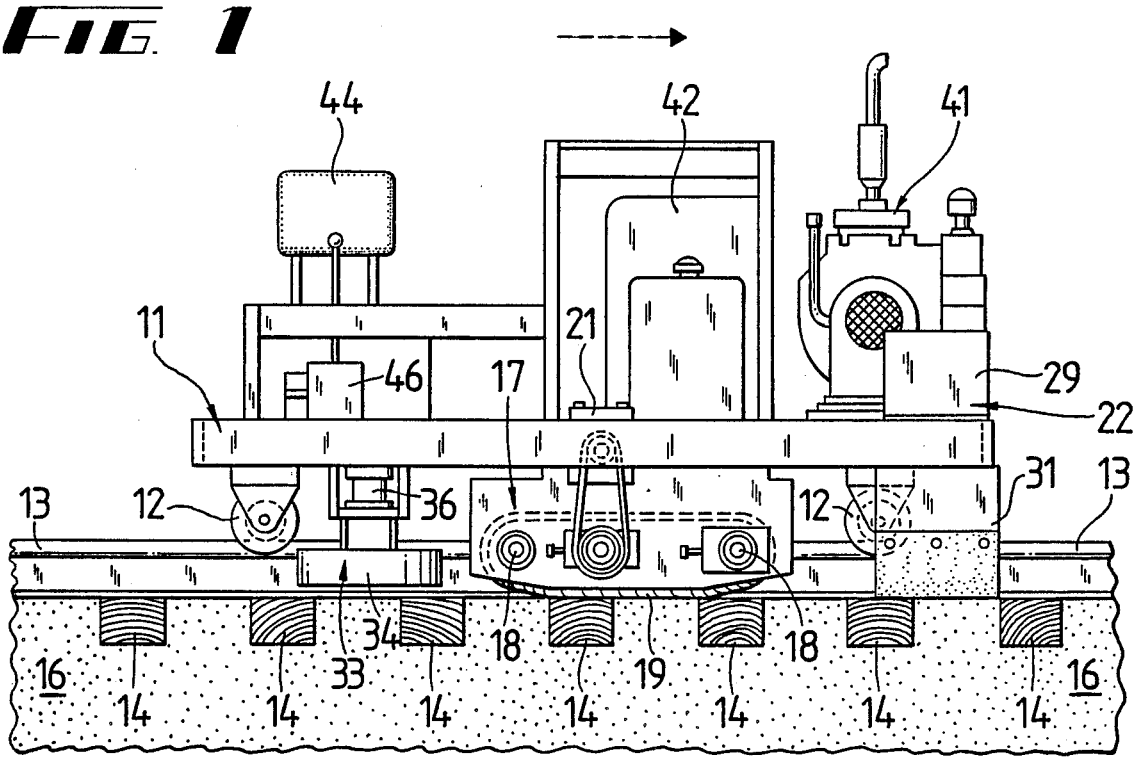
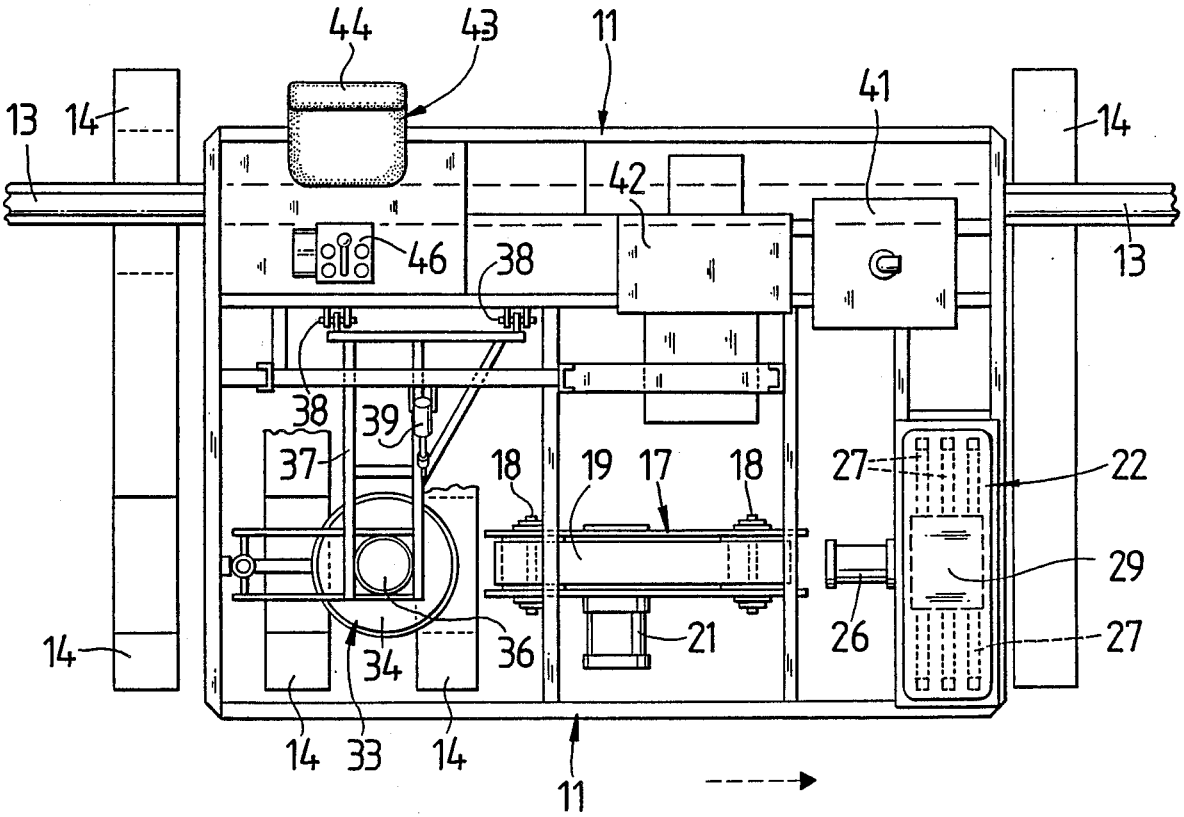
FIG. 2

ADZER CRIBBER

FIELD OF THE INVENTION

The present invention relates to the field of railroad track maintenance equipment and more specifically to equipment for re-laying of the rails. More particularly the present invention relates to apparatus which combine the cribbing and adzing aspects of track re-laying into one machine.

BACKGROUND OF THE INVENTION

Laying and maintaining railroad tracks continues to be a labor-intensive and never-ending task. As the thousands of miles of track already lain ages, it becomes necessary to perform maintenance operations which, in essence, re-lay the track and restore the safety and functionality of the railroad. In days gone by, gangs of men toiled to complete the task with little mechanical help; however, today track maintenance employs a variety of machines. Yet, today time and labor are more expensive than ever before, thus better and faster machines that reduce the need for manpower are needed. Two machines which are candidates for improvement are the cribber and the adzer. The cribber is typically used in relaying operations after one rail has been removed. The machine is placed on the opposite rail, operating as a monorail machine, and removes the ballast between the ties to a depth of approximately three inches below the top of the tie. A plurality of brush elements on a rotating shaft sweep the tie clean for adzing. The adzer is typically a separate unit which minimizes surface irregularities in the ties by precise adzing. This machine usually incorporates a set of rail wheels and a crawler. As may be seen, the two operations are individually performed thus necessitating a plurality of workmen to operate the machines. Consequently, it may also be seen that such use of available manpower is somewhat inefficient.

SUMMARY OF THE INVENTION

It is the object of the present invention to increase the efficiency of the track relaying process and a feature of this object is to reduce the manpower required in the relaying process.

Yet another object of the present invention is to reduce the capital investment associated with railroad track maintenance by reducing the number of machines required for such maintenance.

BRIEF DESCRIPTON OF THE DRAWINGS

Apparatus embodying features of my invention are depicted in the accompanying drawings which form a portion of this disclosure and wherein:

FIG. 1 is a side elevational view of the apparatus in operation;

FIG. 2 is a top plan view of the apparatus in operation;

DESCRIPTION OF A PREFERRED EMBODIMENT

Figure 3:
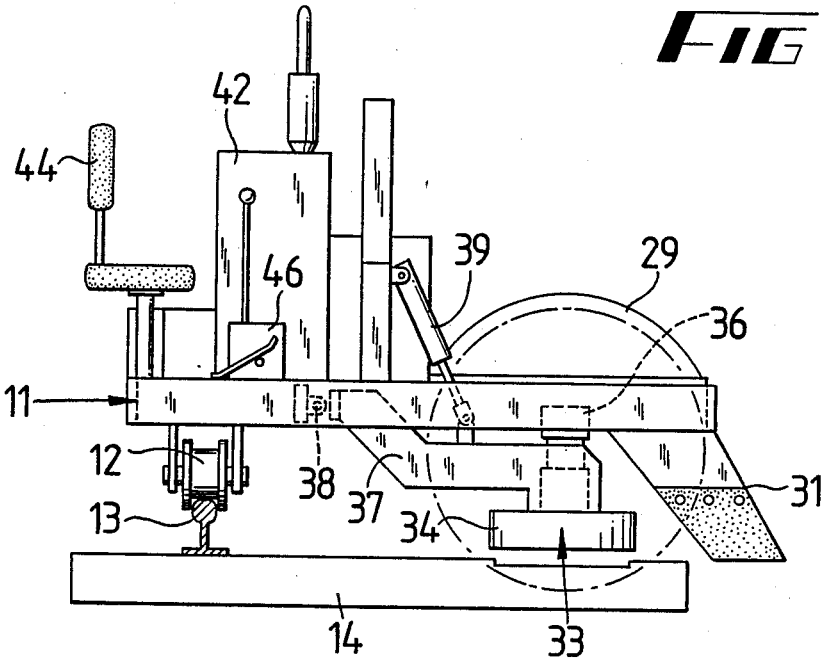
FIG. 3 is an end view of the apparatus taken from the rear thereof.
Figure 4:
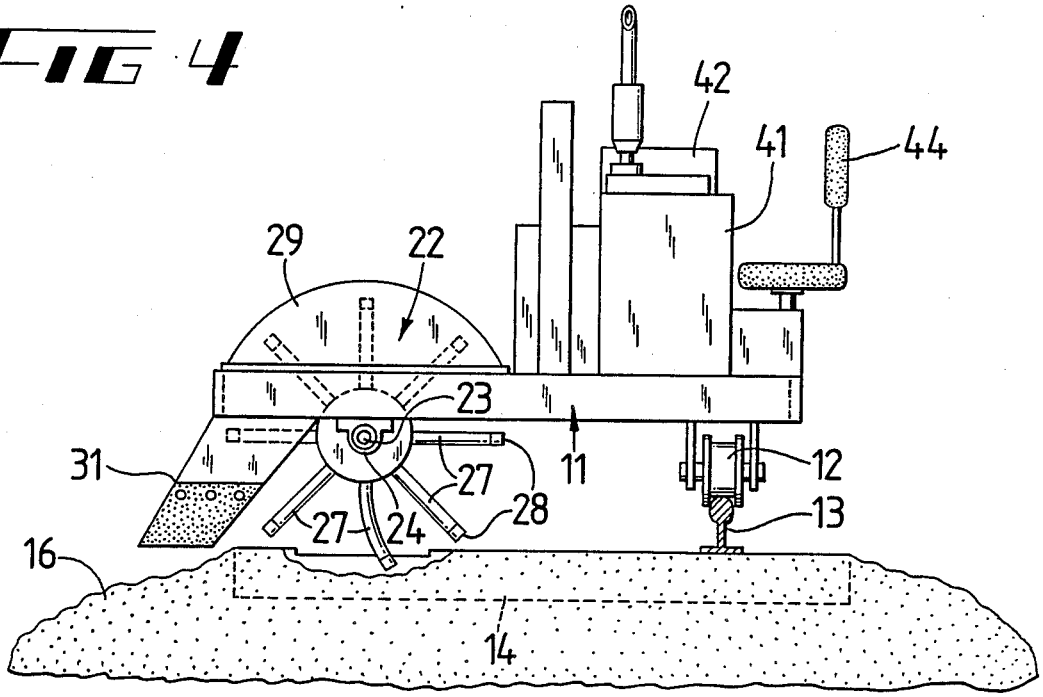
FIG. 4 is a frontal end view of the apparatus in operation.

The present invention combines the cribber and adzer elements into a single self-propelled maintenance machine. As may be seen in FIGS. 1–4, the apparatus utilizes a steel support frame 11 carried on a pair of rail-engaging double flanged wheels 12. The wheels 12 engage a rail 13 of a railroad track which is secured to a plurality of crossties 14 seated in a bed of ballast 16. As will be noted, and as is customary in track re-laying operations, the second rail has been removed from the track. A crawler unit 17 is disposed atop the crossties 14 along the line of the removed rail to support and propel the apparatus along the track. The crawler unit 17 includes a pair of spaced apart axles 18 about which a continuous tread 19 is driven by suitable means, such as a hydraulic motor 21. The axles 18 are spaced apart so that the tread 19 is supported on at least two adjacent crossties 14 at all times.

Forwardly of the crawler unit 17 is a cribber unit 22 which includes a drive shaft 23 mounted in parallel alignment with the track and supported for rotation in a set of bearings 24 supported by frame 11. A hydraulic motor 26 is used to rotate the shaft 24 which carries a plurality of two inch round solid rubber sweeper elements 27 which terminate in a steel wear element 28. A fiberglass cover 29 extends over the top of the sweeper elements and a discharge shroud 31 extends outwardly away from the track.

Rearwardly of the crawler unit 17 is an adzer unit 33 which includes a cutter head 34 mounted for rotation about a verticl axis and a drive unit 36 which may also be a hydraulic motor. The cutter head and drive unit are supported on an arm 37 which is pivotally mounted at one end to the frame 11 by pin and clevis connections 38 such that the arm can pivot about a horizontal axis to raise or lower the cutter head 36. Raising or lowering of the arm 37 is accomplished using a hydraulic actuator 39 mounted between the arm 37 and frame 11.

A diesel engine 41 is provided to provide power to a set of conventional hydraulic pumps mounted within a housing 42. An operator station 43 is provided with a chair 44 and central console 46 which enables a single operator to control the cribbing and adzing operation either simultaneously or independently.

While many elements of the present invention are well known in the prior art, these elements have never been combined as in the Kershaw ® Kribber-Adzer to provide optimum utilization of track maintenance resources. Accordingly the present invention eliminates manpower and machinery while performing the tasks of cribbing and adzing in a single pass.

While I have shown my invention in one form, it will be obvious to those skilled in the art that it is not so limited but is susceptible of various changes and modifications without departing from the spirit thereof.

What I claim is:

1. Apparatus for railroad track maintenance wherein said railroad track includes a rock bed of ballast, a plurality of crossties and first and second parallel rails, said apparatus operable when said first rail is removed, comprising:

(a) wheel means for engaging said second rail;

(b) frame means supported on said wheel means;

(c) driven support means positioned on said crossties distal said second rail for supporting and propelling said frame along said track;

(d) cribber means for dislodging ballast from between said crossties supported by said frame means forward of said driver support means;

(e) adzer means for leveling said crossties distal said second rail supported by said frame means; and (f) means for driving said adzer means, cribber means, and driven support means.

2. Apparatus as defined in claim 1 further comprising an operator's seat supported on said frame.

3. Apparatus as defined in claim 1 wherein said cribber means comprises a plurality of resilient brush elements extending radially from a rotatable shaft aligned parallel to said second rail, and means for rotating said shaft.

4. Apparatus as defined in claim 1 wherein said driven support means comprises:

(a) a set of tread axles supported beneath said frame and spaced apart;

(b) a drive axle supported intermediate said tread axles and operatively connected to said drive means for rotation about a horizontal axis; and (c) a continuous tread, engaged on said tread axles and said drive axle supporting said frame thereon, said tread being a length sufficient to span at least two crossties at all times while in operation.

5. Apparatus as defined in claim 1 wherein said adzer means comprises:

(a) a rotatable adzer head mounted for independent vertical movement relative to said frame; and (b) means for gauging the vertical position of said adzer head.

6. Apparatus as defined in claim 5 wherein said adzer means comprises:

(a) a set of tread axles supported beneath said frame and spaced apart;

(b) a drive axle supported intermediate said tread axles and operatively connected to said drive means for rotation about a horizontal axis; and (c) a continous tread, engaged on said tread axles and said drive axle supporting said frame thereon, said tread being a length sufficient to span at least two crossties at all times while in operation.

7. Apparatus as defined in claim 4 wherein said cribber means comprises a plurality of resilient brush elements extending radially from a rotatable shaft aligned parallel to said second rail, and means for rotating said shaft.

8. Apparatus as defined in claim 5 wherein said cribber means comprises a plurality of resilient brush elements extending radially from a rotatable shaft aligned parallel to said second rail, and means for rotating said shaft.

9. Apparatus as defined in claim 5 further comprising an adzer support frame pivotally mounted at one end thereof to said frame and supporting said adzer head at a second end thereof and a linear actuator connected to said frame and said adzer support frame for urging said adzer support frame about a horizontal axis passing through said one end.

* * * * *